US006980173B2

(12) United States Patent
Man et al.

(10) Patent No.: US 6,980,173 B2
(45) Date of Patent: Dec. 27, 2005

(54) FLOATING CONDUCTOR PAD FOR ANTENNA PERFORMANCE STABILIZATION AND NOISE REDUCTION

(75) Inventors: Ying Tong Man, Kitchener (CA); Robert W. Phillips, Waterloo (CA); Yihong Qi, Waterloo (CA); Perry Jarmuszewski, Waterloo (CA); David John Rooke, Waterloo (CA)

(73) Assignee: Research In Motion Limited, Waterloo (CA)

( * ) Notice: Subject to any disclaimer, the term of this patent is extended or adjusted under 35 U.S.C. 154(b) by 4 days.

(21) Appl. No.: 10/626,160

(22) Filed: Jul. 24, 2003

(65) Prior Publication Data

US 2005/0017906 A1 Jan. 27, 2005

(51) Int. Cl.[7] ..... H01Q 1/52
(52) U.S. Cl. ..... 343/841; 343/702; 343/700 MS
(58) Field of Search ..... 343/702, 841, 343/846, 700 MS; 455/575.7, 73

(56) References Cited

U.S. PATENT DOCUMENTS

| | | | |
|---|---|---|---|
| 3,521,284 | A | 7/1970 | Shelton, Jr. et al. |
| 3,599,214 | A | 8/1971 | Altamayer |
| 3,622,890 | A | 11/1971 | Fujimoto et al. |
| 3,683,376 | A | 8/1972 | Pronovost |
| 4,024,542 | A | 5/1977 | Ikawa et al. |
| 4,074,270 | A | 2/1978 | Kaloi |
| 4,403,222 | A | 9/1983 | Bitter, Jr. et al. |
| 4,471,493 | A | 9/1984 | Schober |
| 4,504,834 | A | 3/1985 | Garay et al. |
| 4,543,581 | A | 9/1985 | Nemet |
| 4,571,595 | A | 2/1986 | Phillips et al. |
| 4,584,709 | A | 4/1986 | Kneisel et al. |
| 4,590,614 | A | 5/1986 | Erat |
| 4,692,769 | A | 9/1987 | Gegan |
| 4,730,195 | A | 3/1988 | Phillips et al. |
| 4,839,660 | A | 6/1989 | Hadzoglou |
| 4,847,629 | A | 7/1989 | Shimazaki |
| 4,857,939 | A | 8/1989 | Shimazaki |
| 4,890,114 | A | 12/1989 | Egashira |
| 4,894,663 | A | 1/1990 | Urbish et al. |
| 4,975,711 | A | 12/1990 | Lee |
| 5,030,963 | A | 7/1991 | Tadama |
| 5,138,328 | A | 8/1992 | Zibrik et al. |

(Continued)

FOREIGN PATENT DOCUMENTS

| | | |
|---|---|---|
| EP | 0543645 | 5/1993 |

(Continued)

OTHER PUBLICATIONS

Patent Abstracts of Japan, vol. 017, No. 264 (E-1370), May 24, 1993 & JP 05 007109 (Mitsubishi Electric Corp.), Jan. 14, 1993, abstract; figures 1-3, 5-7.

(Continued)

*Primary Examiner*—Hoang V. Nguyen
(74) *Attorney, Agent, or Firm*—Jones Day; Krishna K. Pathiyal; Robert C. Liang

(57) ABSTRACT

An antenna in a wireless mobile communication device is often sensitive to its operating environment, such that variations in other device components typically affect performance of the antenna. A floating conductor pad comprising a patch of conductive material is configured to be positioned adjacent the antenna to couple to the antenna. The floating conductor pad thereby has a dominant effect on the antenna in the operating environment. This reduces the effects of variations in the other device components on the antenna. Effective selection of the dimensions and location of the floating conductor pad can also cancel noise generated by the other device components from de-sensitizing communications circuitry in a wireless mobile communication device.

23 Claims, 10 Drawing Sheets

U.S. PATENT DOCUMENTS

| | | | | |
|---|---|---|---|---|
| 5,214,434 | A | 5/1993 | Hsu | |
| 5,218,370 | A | 6/1993 | Blaese | |
| 5,227,804 | A | 7/1993 | Oda | |
| 5,245,350 | A | 9/1993 | Sroka | |
| 5,257,032 | A | 10/1993 | Diamond et al. | |
| 5,347,291 | A | 9/1994 | Moore | |
| 5,373,300 | A | 12/1994 | Jenness et al. | |
| 5,420,599 | A | 5/1995 | Erkocevic | |
| 5,422,651 | A | 6/1995 | Chang | |
| 5,451,965 | A | 9/1995 | Matsumoto | |
| 5,451,968 | A | 9/1995 | Emery | |
| 5,457,469 | A | 10/1995 | Diamond et al. | |
| 5,489,914 | A | 2/1996 | Breed | |
| 5,493,702 | A | 2/1996 | Crowley et al. | |
| 5,541,609 | A | 7/1996 | Stutzman et al. | |
| 5,684,672 | A | 11/1997 | Karidis et al. | |
| 5,701,128 | A | 12/1997 | Okada et al. | |
| 5,767,811 | A | 6/1998 | Mandai et al. | |
| 5,821,907 | A | 10/1998 | Zhu et al. | |
| 5,831,580 | A * | 11/1998 | Taniguchi et al. | 343/713 |
| 5,841,403 | A | 11/1998 | West | |
| 5,870,066 | A | 2/1999 | Asakura et al. | |
| 5,872,546 | A | 2/1999 | Ihara et al. | |
| 5,903,240 | A | 5/1999 | Kawahata et al. | |
| 5,966,098 | A | 10/1999 | Qi et al. | |
| 5,973,651 | A | 10/1999 | Suesada et al. | |
| 5,977,920 | A | 11/1999 | Hung | |
| 5,990,838 | A | 11/1999 | Burns et al. | |
| 6,008,773 | A | 12/1999 | Matsuoka et al. | |
| 6,028,568 | A | 2/2000 | Asakura et al. | |
| 6,031,505 | A | 2/2000 | Qi et al. | |
| 6,034,639 | A | 3/2000 | Rawlins et al. | |
| 6,140,966 | A | 10/2000 | Pankinaho | |
| 6,215,454 | B1 * | 4/2001 | Tran | 343/841 |
| 6,329,951 | B1 | 12/2001 | Wen et al. | |
| 6,335,706 | B1 | 1/2002 | Elliot | |
| 6,337,667 | B1 | 1/2002 | Ayala et al. | |
| 6,348,895 | B1 * | 2/2002 | Tay et al. | 343/702 |
| 6,408,190 | B1 | 6/2002 | Ying | |
| 6,456,249 | B1 | 9/2002 | Johnson et al. | |
| 6,515,634 | B2 | 2/2003 | Desclos et al. | |
| 6,646,610 | B2 * | 11/2003 | Troelsen | 343/702 |
| 6,664,930 | B2 | 12/2003 | Wen et al. | |
| 6,781,548 | B2 | 8/2004 | Wen et al. | |
| 6,791,500 | B2 | 9/2004 | Qi et al. | |
| 2001/0001554 | A1 | 5/2001 | Oshiyama | |
| 2001/0050643 | A1 | 12/2001 | Egorov et al. | |
| 2002/0101380 | A1 | 8/2002 | Pruss et al. | |
| 2002/0140607 | A1 | 10/2002 | Zhou | |
| 2003/0011521 | A1 | 1/2003 | Edlmo et al. | |

FOREIGN PATENT DOCUMENTS

| | | | |
|---|---|---|---|
| EP | 0571124 | | 11/1993 |
| EP | 0765001 | | 3/1997 |
| EP | 0814536 | | 12/1997 |
| EP | 0892459 | | 1/1999 |
| EP | 1018779 | | 7/2000 |
| EP | 1172885 | | 1/2002 |
| EP | 1189304 | | 3/2002 |
| EP | 1189304 | A2 * | 3/2002 |
| EP | 1231671 | A2 * | 8/2002 |
| EP | 1296410 | | 3/2003 |
| EP | 1304765 | | 4/2003 |
| GB | 2330951 | | 5/1999 |
| JP | 55147806 | | 11/1980 |
| JP | 5007109 | | 1/1993 |
| JP | 5129816 | | 5/1993 |
| JP | 5267916 | | 10/1993 |
| JP | 5347507 | | 12/1993 |
| JP | 06097712 | | 4/1994 |
| JP | 6204908 | | 7/1994 |
| WO | 9638881 | | 5/1996 |
| WO | 9733338 | | 9/1997 |
| WO | 9812771 | | 3/1998 |
| WO | 9903166 | | 1/1999 |
| WO | 9925042 | | 5/1999 |
| WO | 0001028 | | 1/2000 |
| WO | 0171844 | | 9/2001 |
| WO | 0178192 | | 10/2001 |
| WO | 0191236 | | 11/2001 |
| WO | 02054539 | | 7/2002 |
| WO | 03047031 | | 6/2003 |

OTHER PUBLICATIONS

Patent Abstracts of Japan, vol. 018, No. 188 (E-1532), Mar. 31, 1994 & JP 05 347507 A (Junkosha Co Ltd), Dec. 27, 1993, abstract; figures 1-19.

* cited by examiner

FLOATING CONDUCTOR PAD FOR ANTENNA PERFORMANCE STABILIZATION AND NOISE REDUCTION

FIELD OF THE INVENTION

This invention relates generally to the field of antennas. More specifically, a floating conductor pad is provided that is particularly well-suited for use in conjunction with antennas in wireless communication devices such as Personal Digital Assistants (PDAs), cellular telephones, and wireless two-way email communication devices.

BACKGROUND OF THE INVENTION

Mobile communication devices ("mobile devices") having various antenna structures are known. Many different types of antennas for mobile devices are also known, including helix, "inverted F", folded dipole, and retractable antenna structures. Helix and retractable antennas are typically installed outside a mobile device, and inverted F and folded dipole antennas are typically embedded inside a mobile device case or housing. Generally, embedded antennas are preferred over external antennas for mobile devices for mechanical and ergonomic reasons. Embedded antennas are protected by the mobile device case or housing and therefore tend to be more durable than external antennas. Although external antennas may physically interfere with the surroundings of a mobile device and make a mobile device difficult to use, particularly in limited-space environments, embedded antennas present fewer such challenges. However, operating characteristics of embedded antennas tend to be affected by other device components.

SUMMARY

According to an aspect of the invention, a floating conductor pad is provided for a wireless communication device comprising an antenna and device components in an operating environment of the antenna. The floating conductor pad comprises a patch of conductive material configured to be positioned adjacent the antenna to couple to the antenna, whereby the floating conductor pad has a dominant effect on the antenna in the operating environment.

An antenna for a wireless communication device having a plurality of device components, according to another aspect of the invention, comprises an antenna element and a floating conductor pad positioned adjacent the antenna element and configured to couple to the antenna element, to thereby reduce effects of variations in the device components on the antenna.

In accordance with another aspect of the invention, a wireless mobile communication device comprises a transceiver incorporating transceiver components, an antenna connected to the transceiver, and a floating conductor pad positioned adjacent the antenna and configured to couple to the antenna to reduce effects of variations in the transceiver components on the antenna.

DETAILED DESCRIPTION

Figure 1:
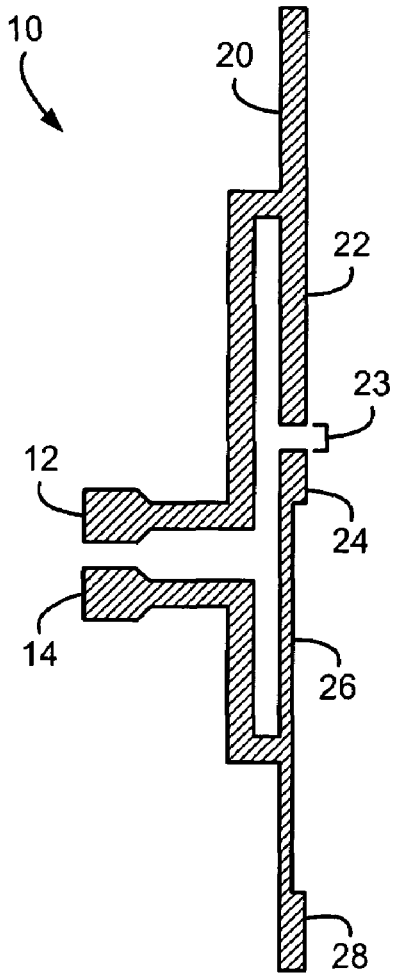
FIG. 1 is a top view of an antenna.

Antennas are typically designed to operate in one or more particular operating frequency bands. Multi-band antennas are often implemented with multiple antenna elements tuned to different operating frequency bands. For example, suitably tuned separate antenna elements enable a multiple-element antenna for operation at the Global System for Mobile Communications (GSM) and General Packet Radio Service (GPRS) frequency bands at approximately 900 MHz and 1800 MHz or 1900 MHz, or at the Code Division Multiple Access (CDMA) frequency bands at approximately 800 MHz and 1900 MHz. Where desired operating frequency bands are relatively closely spaced, within 100–200 MHz, or sometimes where the bands are harmonically related, a single antenna element may be configured for multi-band operation. In a GPRS mobile device, for example, operation in all three frequency bands may be desired to support communications in networks in different countries or regions using a common antenna structure. In one known antenna design, tri-band operation is achieved using only two antenna structures connected to respective transceivers, including one antenna element tuned to 900 MHz, and another antenna element tuned for operation within a broader frequency band including the two other frequency bands at 1800 MHz and 1900 MHz. This type of antenna structure enables three operating frequency bands using only two antenna elements.

However, as those skilled in the art of antenna design will appreciate, environments in which antennas are implemented are not always stable. Even slight variations in the design of communications circuitry, including changes in layout or component values, may cause an antenna connected to the communications circuitry to underperform, often to such a degree that necessitates changes in antenna design. Although design changes can be foreseen and their effects predicted or analyzed, other variations such as fluctuations in component values from ideal values are less easily anticipated. For example, dielectric properties of printed circuit boards (PCBs) on which components of mobile devices are built can vary as a result of different batches of material used to fabricate the PCBs. Warpage of a PCB after fabrication can change the position of the PCB or a portion thereof, moving it toward or away from an antenna, which similarly affects the operating environment of the antenna.

Noise generated by other device components can also affect an embedded antenna. While this type of noise does not normally affect the performance of the antenna itself, it can affect overall system performance by de-sensitizing a receiver connected to the antenna. Higher noise levels make communication signal detection and reception more difficult. According to one known mobile device design, a keyboard is positioned above a PCB that carries a device receiver and adjacent to a portion of an embedded antenna. In such a device, pressing a key on the keyboard creates noise that couples to the antenna and degrades overall system performance.

FIG. 1 is a top view of an antenna. The antenna 10 includes a first conductor section 22 and a second conductor section 26. The first and second conductor sections 22 and 26 are positioned to define a gap 23, thus forming an open-loop structure known as an open folded dipole antenna. In alternative embodiments, other antenna designs may be utilized, such as a closed folded dipole structure, for example.

The first conductor section 22 includes a top load 20 that is used to set an operating frequency band of the antenna 10. As described briefly above, this operating frequency band may be a wide frequency band containing multiple operating frequency bands, such as 1800 MHz and 1900 MHz. The dimensions of the top load 20 affect the total electrical length of the first antenna element 10, and thus may be adjusted to tune the antenna 10. For example, decreasing the size of the top load 20 increases the frequency of the operating frequency band of the antenna 10 by decreasing its total electrical length. In addition, the frequency of the operating frequency band of the antenna 10 may be further tuned by adjusting the size of the gap 23 between the conductor sections 22 and 26, or by altering the dimensions of other portions of the antenna 10.

The second conductor section 26 includes a stability patch 24 and a load patch 28. The stability patch 24 is a controlled coupling patch which affects the electromagnetic coupling between the first and second conductor sections 22 and 26 in the operating frequency band of the antenna 10. The electromagnetic coupling between the conductor sections 22 and 26 is further affected by the size of the gap 23, which is selected in accordance with desired antenna characteristics.

The antenna 10 also includes two ports 12 and 14, one connected to the first conductor section 22 and the other connected to the second conductor section 26. The ports 12 and 14 are offset from the gap 23 between the conductor sections 22 and 26, resulting in a structure commonly referred to as an "offset feed" open folded dipole antenna. However, the ports 12 and 14 need not necessarily be offset from the gap 23, and may be positioned, for example, to provide space for, or so as not to physically interfere with, other components of a mobile device in which the antenna 10 is implemented. The ports 12 and 14 are configured to couple the antenna 10 to communications circuitry. In one embodiment, the port 12 is coupled to a ground plane, while the port 14 is coupled to a signal source. The ground and signal source connections may be reversed in alternate embodiments, with the port 12 being coupled to a signal source and the port 14 being grounded. Although not shown in FIG. 1, those skilled in the art will also appreciate that either or both of the ports 12 and 14 may be connected to a matching network, in order to match impedance of the antenna 10 with the impedance of a communications circuit or device to which the antenna 10 is coupled.

As described above, embedded antennas tend to be prone to external effects of the environment in which they operate. According to an aspect of the invention, a floating conductor pad is provided in a mobile device.

Figure 2:
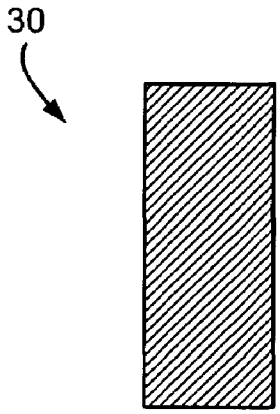
FIG. 2 is a top view of a floating conductor pad.

FIG. 2 is a top view of a floating conductor pad. The floating conductor pad 30 is a conductive pad or patch, fabricated from a conductive material such as copper or silver. Those skilled in the art will appreciate that the dimensions of the conductor pad 30 affect coupling between and antenna and the conductor pad 30. Although FIG. 2 shows a rectangular conductor pad 30, the invention is in no way restricted thereto.

Figure 3:
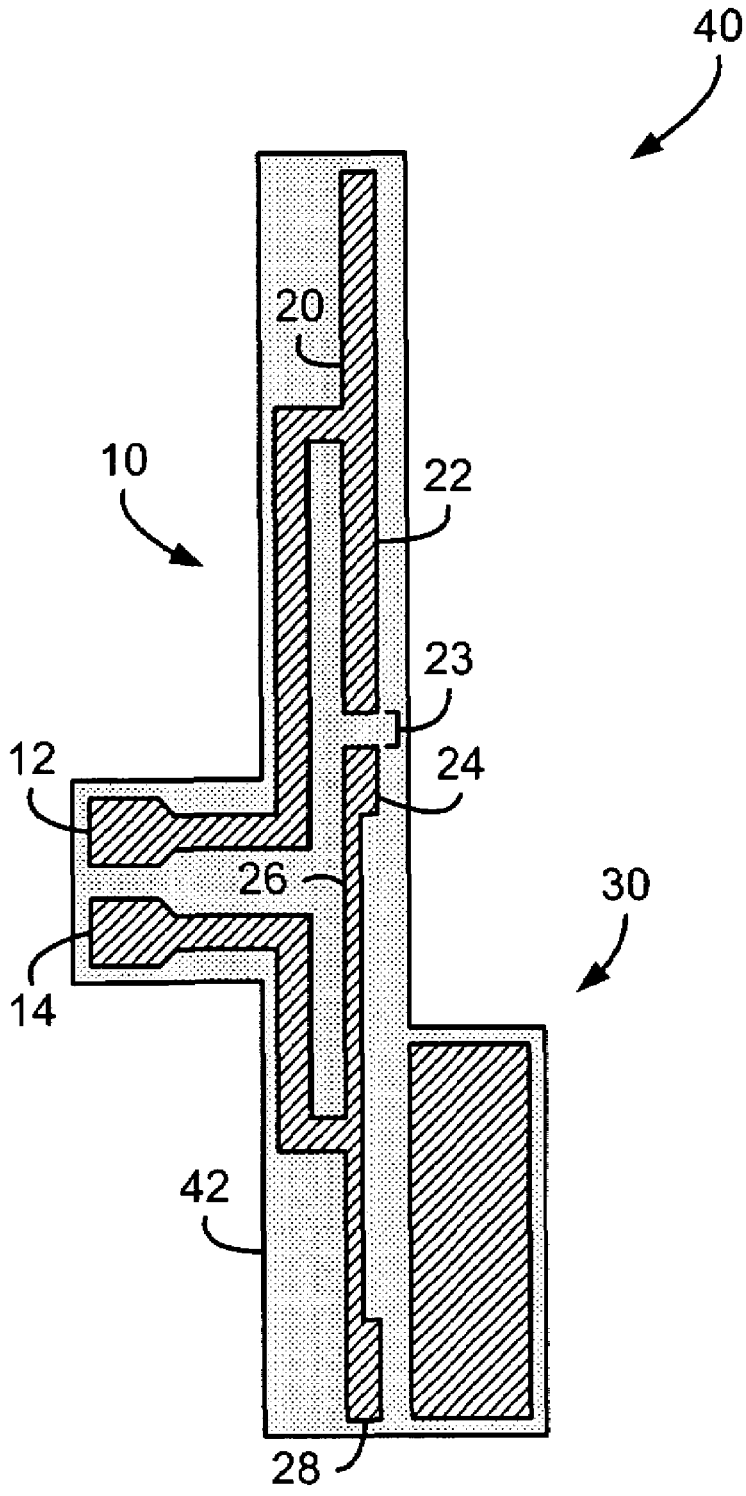
FIG. 3 is a top view of an antenna including the antenna of FIG. 1 and the floating conductor pad of FIG. 2.

FIG. 3 is a top view of an antenna including the antenna of FIG. 1 and the floating conductor pad of FIG. 2. As shown, the antenna 10 is an antenna element of the antenna 40, and the floating conductor pad 30 is not connected to the antenna 10. In the antenna 40, the antenna 10 as shown in FIG. 1 and the floating conductor pad 30 of FIG. 2 are positioned such that at least a portion of the antenna 10 is adjacent at least a portion of the floating conductor pad 30. The antenna 40 is fabricated on a flexible dielectric substrate 42, using copper conductor and known copper etching techniques, for example, such that a portion of the second conductor section 26, is adjacent to and overlaps the floating conductor pad 30. The proximity of the first antenna element 10 and the floating antenna element 30 results in electromagnetic coupling between the two antenna elements 10 and 30.

In operation, the antenna 10 enables communications in an operating frequency band. The antenna 10 is tuned to optimize either a single frequency band, such as the CDMA Personal Communication System (PCS) 1900 MHz band, or wide-band operation in multiple frequency bands, such as GSM-1800 (1800 MHz), also known as DCS, and GSM-1900 (1900 MHz), for example. Communications signals are routed between the antenna 10 and communications circuitry through the ports 12 and 14. As described in further detail below, the floating conductor pad 30 reduces the effects of an operating environment on the antenna 10.

FIG. 3 represents an implementation of a floating conductor pad in conjunction with an antenna, according to one embodiment of the present invention. In alternative embodiments, the antenna 10 and the floating conductor pad 30 or parts thereof may overlap to a lesser degree. Other structures of the antenna 10 and the floating conductor pad 30 than those shown in FIG. 3 are also possible. The dimensions and spacing of an antenna element and a conductor pad in such alternate structures are preferably adjusted so that the floating conductor pad has the greatest possible effect in stabilizing the performance of the antenna and communications circuitry to which the antenna is connected. In addition, fabrication of the antenna 10 and the floating conductor pad 30 on a single substrate 42 is optional, because the antenna 10 and the floating conductor pad 30 are not connected. Single substrate fabrication is desirable, for example, where the antenna 10 and the floating conductor pad 30 are intended for installation in a mobile device at the same time. Separate fabrication is preferred in such situations as where an antenna and a conductor pad are installed separately or using different installation techniques. In another embodiment, the antenna 10 is fabricated in its final shape instead of in a substantially flat orientation, at the same time or separately from the floating conductor pad 30.

Figure 4:
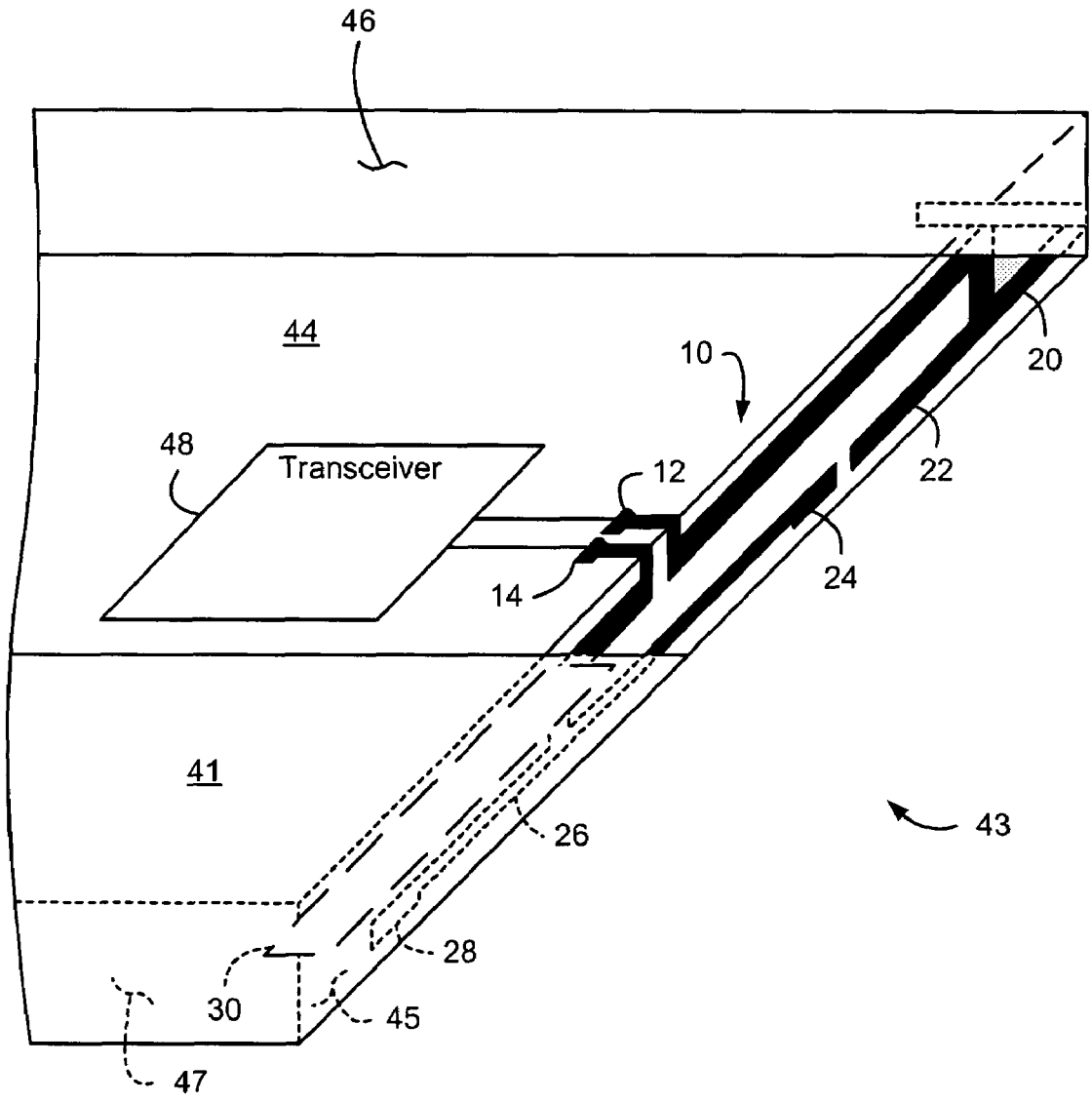
FIG. 4 is an isometric view of the antenna of FIG. 3 mounted in a mobile communication device.

FIG. 4 is an isometric view of the antenna of FIG. 3 mounted in a mobile communication device. Those skilled in the art will appreciate that a portion of a front housing wall 41 and a majority of internal components of the mobile device 43, which would obscure the view of the antenna, have not been shown in FIG. 4. In an assembled mobile device, the embedded antenna shown in FIG. 4 is not visible. It will also be apparent that the substrate 42 has not been shown in FIG. 4, to avoid congestion in the drawing.

The mobile device 43 comprises a case or housing having a front wall 41, a rear wall 44, a top wall 46, a bottom wall 47, and side walls, one of which is shown at 45. In addition, the mobile device 43 includes a transceiver 48, a CDMA PCS transceiver for example, connected to the ports 12 and 14 of the antenna 10 and mounted within the housing.

The antenna 10, including the substrate 42 (FIG. 3) on which the antenna is fabricated, is mounted inside the housing of the mobile device 43. The substrate 42 and thus the antenna 10 is folded from an original, substantially flat configuration such as illustrated in FIG. 3, so as to extend around the inside surface of the mobile device housing to orient the antenna 10 in multiple planes. The antenna 10 is folded and mounted along the rear, side, and top walls 44, 45, and 46. The ports 12 and 14 are mounted on the rear wall 44 and connected to the transceiver 48. The first conductor section 22 extends along the side wall 45, around a top corner, and along and the top wall 46. The floating conductor pad 30 is positioned parallel to the front wall 41, either along the front wall 41 or adjacent another component of the mobile device 43. Where the floating conductor pad 30 and the antenna 10 are located on a single substrate, the substrate extends along the side wall 45 and then in a direction parallel to the front wall 41.

As described briefly above, changes or variations in the transceiver 48, PCBs, and other mobile device components may affect performance of the antenna 10. The effects of such variations are reduced by selecting the location of the floating conductor pad 30. The floating conductor pad 30 is preferably placed in the vicinity of a high voltage area of the antenna 10. An antenna is typically most sensitive to its operating environment at its high voltage point. As shown most clearly in FIG. 3, the floating conductor pad 30 is located at the high voltage area at the tip of the antenna 10. The distance between the antenna 10 and the floating conductor pad 30 is preferably selected to minimize the effect of the floating conductor pad 30 on antenna return loss.

When positioned in this manner, the floating conductor pad 30 couples to the antenna 10 at its most sensitive portion, and thereby has a dominant effect on the antenna 10. The antenna 10 effectively "sees" the floating conductor pad 30 as the dominant object in its operating environment, and is thus masked from seeing minor variations in the transceiver 48 and other components of the mobile device 43. Since the dimensions and location of the floating conductor pad 30 are less prone to variations than other components of the mobile device 43, the floating conductor pad 30, as a relatively stable dominant object, stabilizes the operating environment of the antenna 10.

In one embodiment of the invention, the mobile device 43 includes a first PCB that is mounted toward the rear wall 44 and carries components of the transceiver 48, and a second PCB that is mounted above the first PCB toward the front wall 41 and carries components of a keyboard. The floating conductor pad 30 is then positioned on or along the keyboard PCB.

In such a mobile device, operation of the keyboard also produces noise that would normally couple to the antenna 10 and de-sensitize the transceiver 48. However, the floating conductor pad 30 can also be adapted to block this noise from entering the antenna 10. The size and shape of the floating conductor pad 30 are selected to cover the most noisy radiation source close to the antenna 10, a keyboard in this example. Generally, the larger the floating conductor pad, the better the noise reduction.

From an electromagnetic point of view, the floating conductor pad 30 reduces noise produced by dipole and loop type radiation mechanisms. For a dipole type noise source, the floating conductor pad 30 provides a flat metallic plate in the proximity of the noise source. The noise source induces a current in the floating conductor pad 30 that is equal in amplitude but opposite in direction to the noise source current. As such, the current generated in the floating conductor pad 30 has a canceling effect on noise from the noise source. Similarly, a loop type noise source induces an equal but opposite eddy current in the floating conductor pad 30, resulting in a canceling effect on the noise source.

The position of the floating conductor pad 30 as shown in FIG. 4 is effective for canceling noise from a keyboard that extends across the front wall 41 near the bottom wall 47 and in a direction substantially parallel thereto, for example. In such a configuration, noise generated at a portion of the keypad closes to the antenna 10 is canceled by the floating conductor pad 30.

Thus, the floating conductor pad 30 may be configured to reduce the effects of one or more components in the operating environment of the antenna 10.

Although FIG. 4 shows one orientation of an antenna and a floating conductor pad within the mobile device 43, it should be appreciated that the antenna and the floating conductor pad may be mounted in different ways, depending upon the type of housing, for example. In a mobile device with substantially continuous rear, top, side, and bottom walls, an antenna 10 may be mounted directly to the housing, with the floating conductor pad 30 being positioned and mounted to a suitably oriented part of the housing or another device component as the device is assembled. Many mobile device housings are fabricated in separate parts that are attached together when internal components of the mobile device have been placed. Often, the housing sections include a front section and a rear section, each including a portion of the top, side and bottom walls of the housing. Unless the portion of the top, side, and bottom walls in the rear housing section is of sufficient size to accommodate the antenna 10 and the floating conductor pad 30, then mounting on the housing as shown in FIG. 4 might not be practical. In such mobile devices, the antenna 10 and the floating conductor pad 30 are preferably attached to an antenna frame that is integral with or adapted to be mounted on the mobile device housing, a structural member in the mobile device, or another component of the mobile device. Where the antenna 10 and the floating conductor pad 30 are fabricated on a substrate, mounting or attachment is preferably accomplished using an adhesive provided on or applied to the substrate, the component to which the antenna 10 and the floating conductor pad 30 is mounted or attached, or both.

Other mounting or assembly options, where the antenna 10 and the floating conductor pad 30 are fabricated or mounted separately, for example, are also possible. In the dual-PCS example described above, the floating conductor pad may be mounted or possibly printed on either of the PCBs, or oriented adjacent one or both of the PCBs without necessarily being attached to a PCB. It is also contemplated that more than one floating conductor pad may be implemented in a mobile device, for instance to cancel noise from different noise sources or to provide a dominant effect over particular device components. In multiple-PCB mobile devices, each PCB could carry one or more floating conductor pads.

The mounting arrangement shown in FIG. 4 is intended for illustrative purposes only. An antenna and a floating conductor pad may be mounted on fewer, further, or different surfaces of a mobile device or mobile device housing. For example, housing surfaces on which these elements are mounted need not necessarily be flat, perpendicular, or any particular shape.

Although the preceding description describes a floating conductor pad in conjunction with a single antenna element 10, it should be appreciated that a floating conductor pad may be implemented in multiple-element antennas having more than one antenna element. Illustrative examples of multiple-element antennas incorporating a first antenna element, a second antenna element, and a floating conductor pad are described below.

Figure 5:
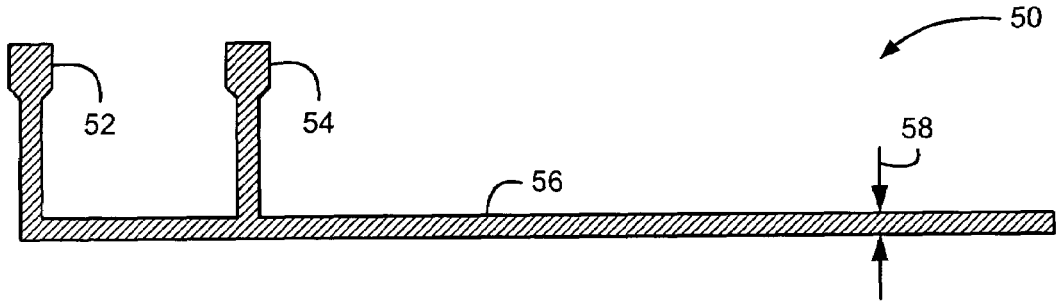
FIG. 5 is a top view of another antenna.

FIG. 5 is a top view of another antenna. The antenna 50 includes a first port 52, a second port 54, and a top conductor section 56 connected to the ports 52 and 54. As will be apparent to those skilled in the art, the ports 52 and 54 and the top conductor section 56 are normally fabricated from conductive material such as copper, for example. The length of the top conductor section 56 sets an operating frequency band of the antenna 50.

Figure 6:
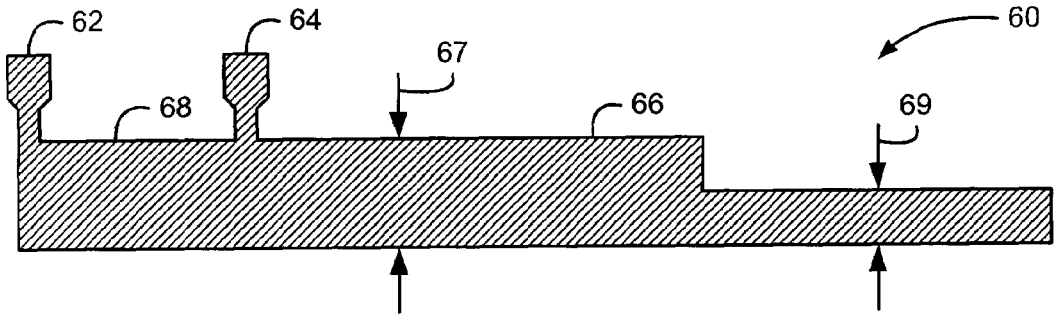
FIGS. 6–8 are top views of alternative implementations of the type of antenna in FIG. 5.
Figure 7:
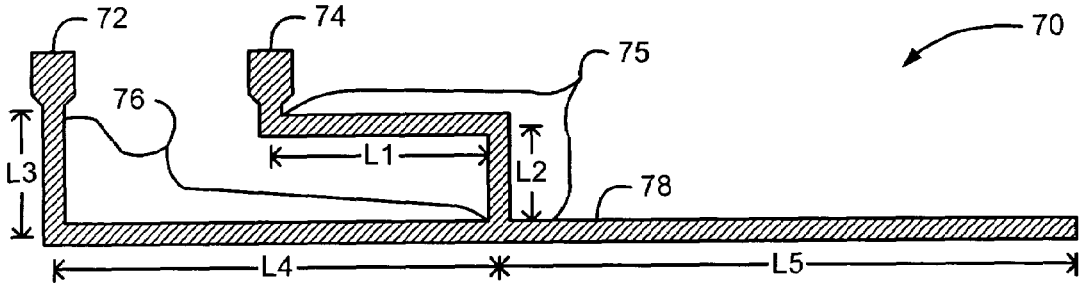
Figure 8:
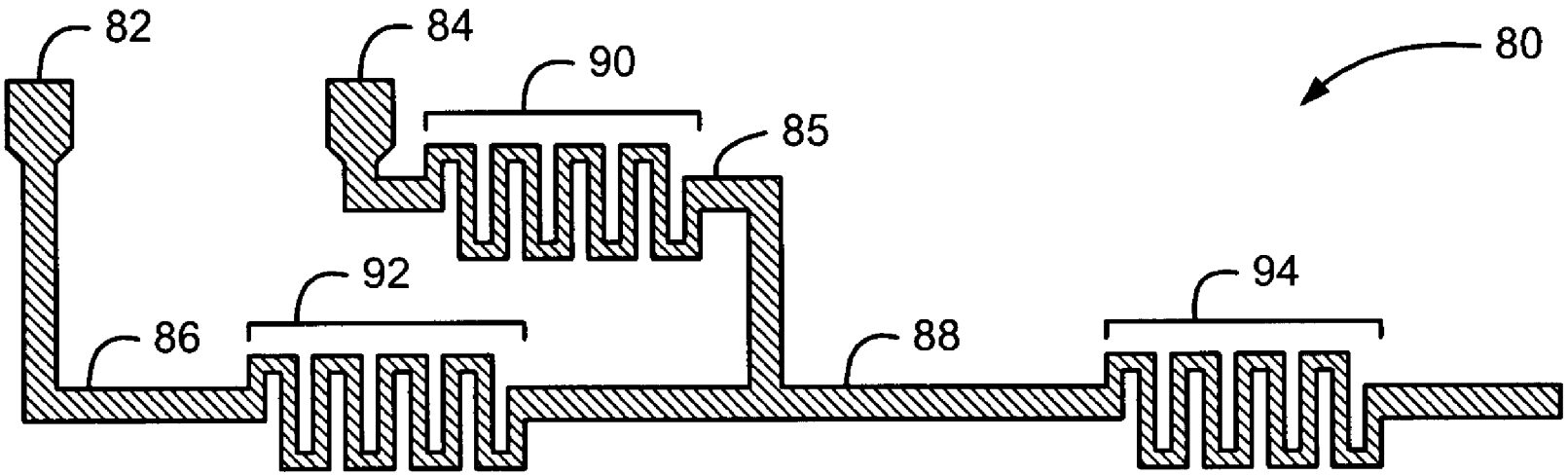

FIGS. 6–8 are top views of alternative implementations of the type of antenna in FIG. 5. Whereas the top conductor section 56 of the antenna 50 has substantially uniform width 58, the alternative antenna 60 shown in FIG. 6 has a top conductor section 66 with non-uniform width. As shown in FIG. 6, the portion 68 between the ports 62 and 64 and part of the top conductor section 66 of the antenna 60 have a width 67, and an end portion of the antenna element 60 has a smaller width 69. A structure as shown in FIG. 6 is useful, for example, to provide space for other antenna elements, such as a parasitic coupler, in order to conserve space. As those skilled in the art will appreciate, the length and width of the antenna 60 or portions thereof are selected to set gain, bandwidth, impedance match, operating frequency band, and other characteristics of the antenna.

FIG. 7 shows a top view of a further alternative antenna. The antenna 70 includes ports 72 and 74, and first, second and third conductor sections 75, 76 and 78. The operating frequency band of the antenna 70 is primarily controlled by selecting the lengths of the second and third conductor sections 76 and 78. Any of the lengths L3, L4 and L5 may be adjusted to set the lengths of the second and third conductor sections 76 and 78, whereas the length of the first conductor section 75 may be set for impedance matching purposes by adjusting the lengths L1, L2, or both. Although the lengths of the first, second and third conductor sections are adjusted to control the above operating characteristics of the antenna 70, adjustment of the length of any of these conductor sections has some effect on the characteristic controlled primarily by the other antenna conductor sections. For example, increasing L3, L4 or L5 to decrease the operating frequency band of the antenna 70 may also necessitate adjustment of one or both of the lengths L1 and L2, since changing L3, L4 or L5 also affects the impedance and thus the matching of the antenna 70.

Any of the first, second and third conductor sections of the antenna 70 may include a structure to increase its electrical length, such as a meandering line or sawtooth pattern, for example. FIG. 8 is a top view of another alternative antenna, similar to the antenna 70, including ports 82 and 84 and meandering lines 90, 92 and 94 to increase the electrical length of the first, second and third conductor sections 85, 86 and 88. The meandering lines 92 and 94 change the lengths of the second and third conductor sections 86 and 88 of the antenna 80 in order to tune it to a particular operating frequency band. The meandering line 94 also top-loads the antenna 80 such that it operates as though its electrical length were greater than its actual physical dimension. The meandering line 90 similarly changes the electrical length of the first conductor section for impedance matching. The electrical length of the any of the meandering lines 90, 92 and 94, and thus the total electrical length of the first, second and third conductor sections 85, 86 and 88, may be adjusted, for example, by connecting together one or more segments of the meandering lines to form a solid conductor section.

Figure 9:
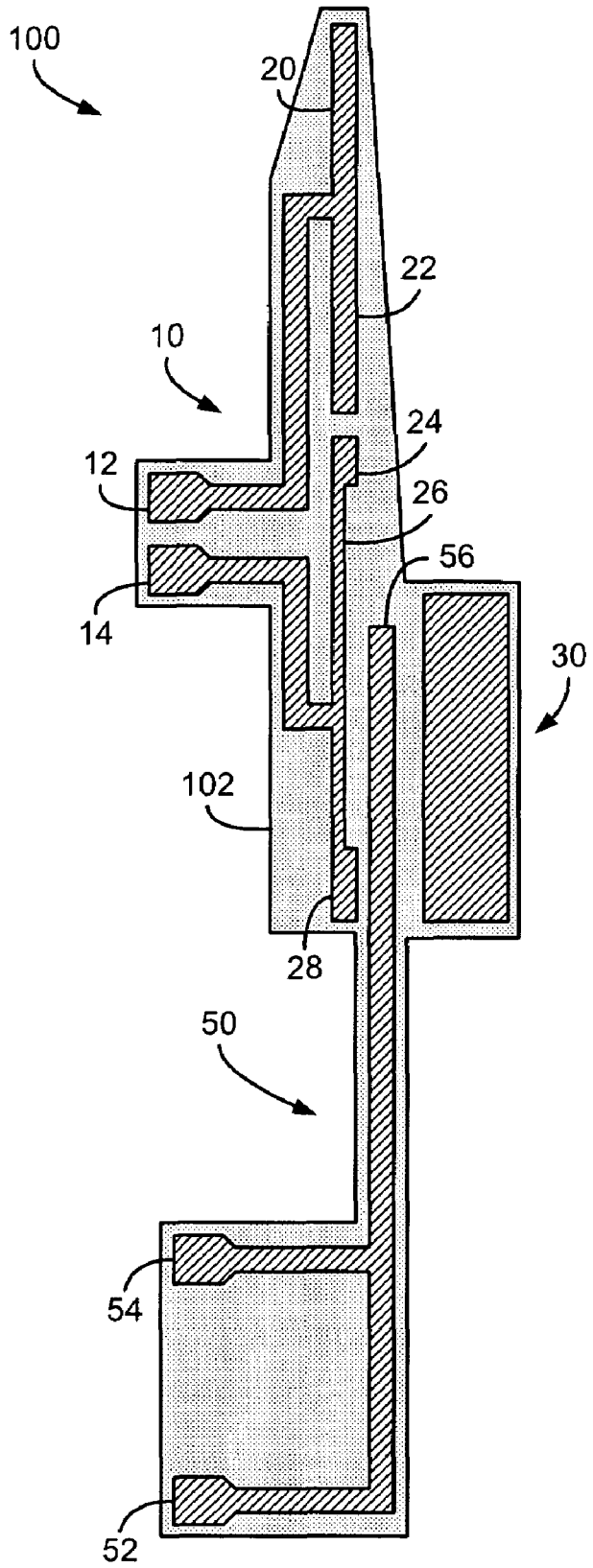
FIG. 9 is a top view of a multiple-element antenna including a first antenna element, a second antenna element, and a floating conductor pad.

FIG. 9 is a top view of a multiple-element antenna including a first antenna element, a second antenna element, and a floating conductor pad. The antenna 10 and the antenna 50 are first and second antenna elements, respectively of the multiple-element antenna 100. In the multiple-element antenna 100, the first antenna element 10, the second antenna element 50, and the floating conductor pad 30 are positioned adjacent each other on a substrate 102. The floating conductor pad 30 operates in conjunction with the first and second antenna elements 10 and 30 substantially as described above to stabilize the performance of the antenna elements and reduce the effects of noise generated by components external to the antenna 100. As those skilled in the art will appreciate, the high voltage point of the antenna element 50 is its tip, which is in the vicinity of the floating conductor pad 30.

The second antenna element 50 as shown in FIG. 5 is positioned such that at least a portion of the second antenna element 50 is adjacent at least a portion of the first antenna element 10. In FIG. 9, the antenna elements 10 and 50 are fabricated on the substrate 102 such that a portion of the top conductor section 56 of the second antenna element 50 is adjacent to and partially overlaps the second conductor section 26 of the first second antenna element 10. The proximity of the first antenna element 10 and the second antenna element 50 results in electromagnetic coupling between the two antenna elements 10 and 50. Although the first antenna element 10 and the second antenna element 50 are typically tuned to optimize corresponding first and second operating frequency bands, each antenna element 10 and 50 acts as a parasitic element to the other due to the electromagnetic coupling therebetween, thus improving performance of the multiple-element antenna 100 by smoothing current distributions in each antenna element 10 and 50 and increasing the gain and bandwidth at the operating frequency bands of both the first and second antenna elements 10 and 50. For example, in a mobile device designed for operation in a GPRS network, the first operating frequency band may include both the GSM-1800 (1800 MHz) or DCS, and the GSM-1900 (1900 MHz) or PCS frequency bands, whereas the second operating frequency band is the GSM-900 (900 MHz) frequency band. In a CDMA mobile device, the first and second operating frequency bands may include the CDMA bands at approximately 1900 MHz and 800 MHz, respectively. Those skilled in the art will appreciate that the first and second antenna elements 10 and 50 may be tuned to other first and second operating frequency bands for operation in different communication networks.

FIG. 9 represents an illustrative example of a multiple-element antenna. The dimensions, shapes, and orientations of the various patches, gaps, and conductors that affect coupling between the elements 10, 30, and 50 may be modified to achieve desired antenna characteristics. For example, although the second antenna element 50 is shown in the multiple-element antenna 100, any of the alternative antenna elements 60, 70, and 80, or a second antenna element combining some of the features of these alternative second antenna elements, could be used instead of the second antenna element 50. Other forms of the first antenna element 10 and the floating conductor pad 30 may be used in alternative embodiments. Fabrication of the antenna elements 10 and 50 and the floating conductor pad 30 on a single substrate 102 is also optional.

Figure 10:
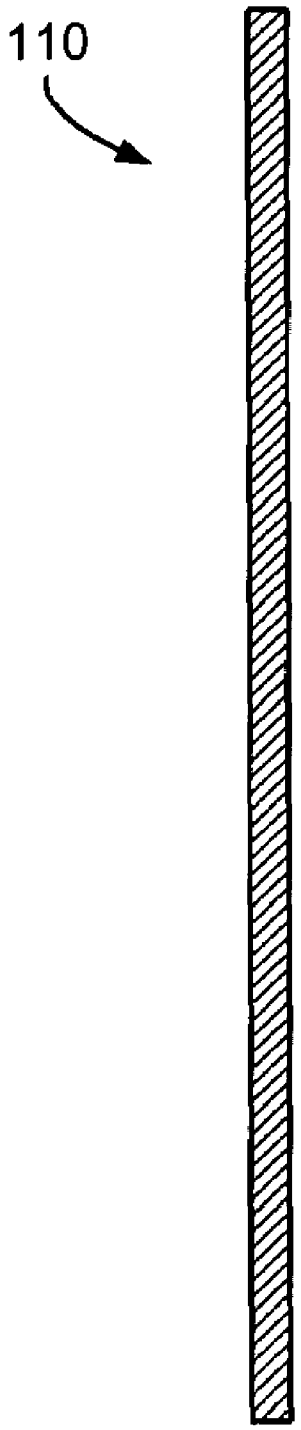
FIG. 10 is a top view of a parasitic coupler.

FIG. 10 is a top view of a parasitic coupler. A parasitic coupler is a parasitic element, a single conductor 110 in FIG. 10, which is used to improve electromagnetic coupling between first and second antenna elements, as described in further detail below, to thereby improve the performance of each antenna element in its respective operating frequency band and smooth current distributions in the antenna elements.

Figure 11:
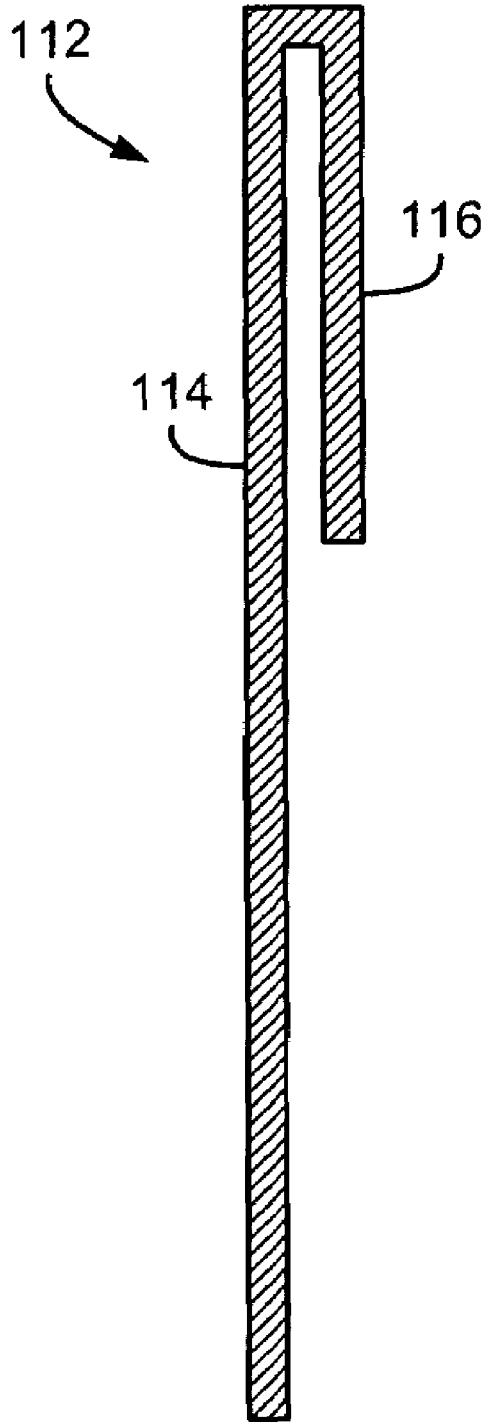
FIG. 11 is a top view of an alternative parasitic coupler.

A parasitic coupler need not necessarily be a substantially straight conductor as shown in FIG. 10. FIG. 11 is a top view of an alternative parasitic coupler. The parasitic coupler 112 is a folded or curved conductor which has a first conductor section 114 and a second conductor section 116. A parasitic coupler such as 112 is used, for example, where physical space limitations exist.

It should also be appreciated that a parasitic coupler may alternatively comprise adjacent, connected or disconnected, conductor sections. For example, two conductor sections of the type shown in FIG. 10 could be juxtaposed so that they overlap along substantially their entire lengths to form a "stacked" parasitic element. In a variation of a stacked parasitic element, the conductor sections only partially overlap, to form an offset stacked parasitic element. End-to-end stacked conductor sections represent a further variation of multiple-conductor section parasitic elements. Other parasitic element patterns or structures, adapted to be accommodated within available physical space or to achieve particular electromagnetic coupling and performance characteristics, will also be apparent to those skilled in the art.

Figure 12:
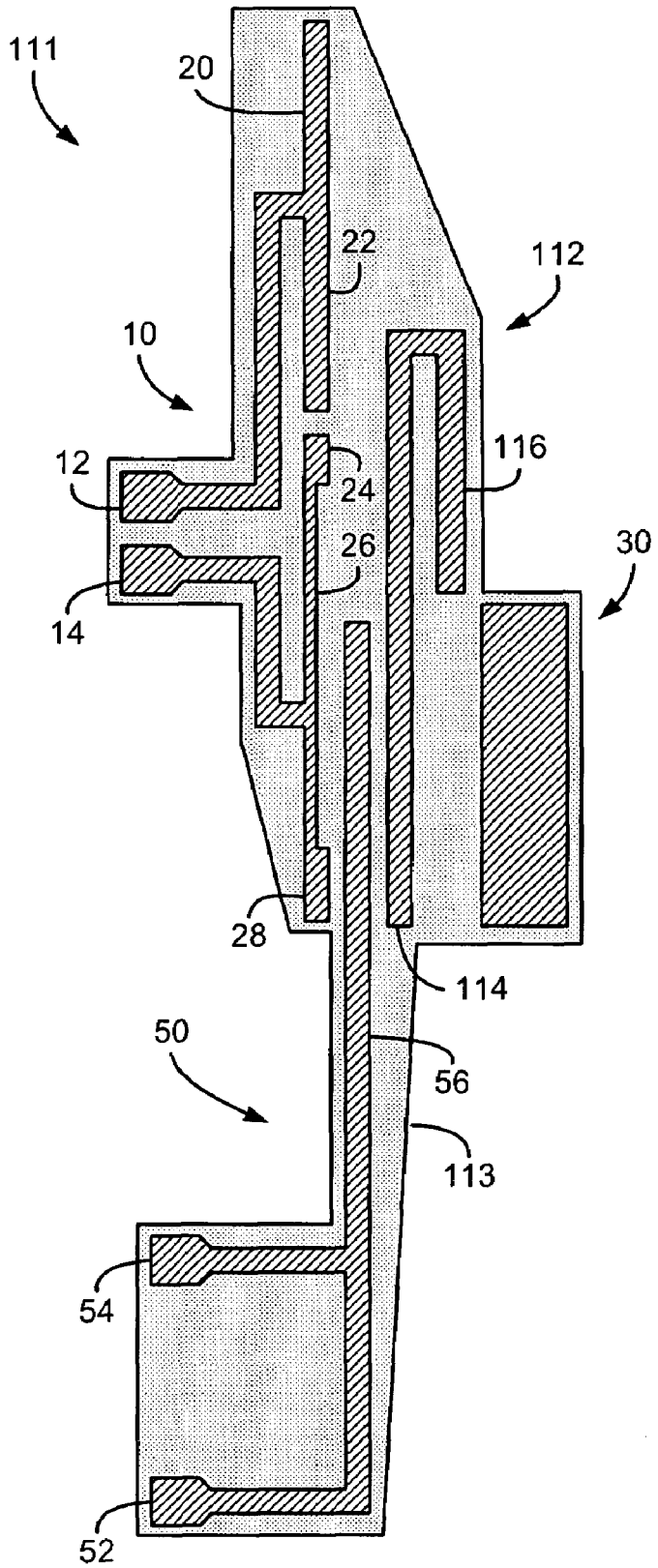
FIG. 12 is a top view of a further multiple-element antenna including a parasitic coupler.

FIG. 12 is a top view of a further multiple-element antenna including a parasitic coupler. The multiple-element antenna 111 includes the first and second antenna elements 10 and 50, the floating conductor pad 30, and the parasitic coupler 112. As shown, the parasitic coupler 112 is adjacent to and overlaps a portion of both the first antenna element 10 and the second antenna element 50, as well as the floating conductor pad 30.

In the multiple-element antenna 111, part of the first conductor section 114 of the parasitic coupler 112 is positioned adjacent to the top conductor section 56 of the second antenna element 50 and electromagnetically couples therewith. The second conductor section 116 and a portion of the first conductor section 114 of the parasitic coupler 12 similarly overlap a portion of the first antenna element 10 in order to electromagnetically couple the parasitic coupler 112 with the first antenna element 10. The parasitic coupler 112 thereby electromagnetically couples with both the first antenna element 10 and the second antenna element 50.

The second antenna element 50 tends to exhibit relatively poor communication signal radiation and reception in some types of mobile devices. Particularly when implemented in a small mobile device, the length of the top conductor section 56 is limited by the physical dimensions of the mobile device, resulting in poor gain. The presence of the parasitic coupler 112 enhances electromagnetic coupling between the first antenna element 10 and the second antenna element 50. Since the first antenna element 10 generally has better gain than the second antenna element 50, this enhanced electromagnetic coupling to the first antenna element 10 improves the gain of the second antenna element 50 in its operating frequency band. When operating in its operating frequency band, the second antenna element 50, by virtue of its position relative to the first antenna element 10, electromagnetically couples to the second conductor section 26 of the first antenna element 10. Through the parasitic coupler 112, the second antenna element 50 is more strongly coupled to the second conductor section 26 and also electromagnetically couples to the first conductor section 22 of the first antenna element 10.

The parasitic coupler 112 also improves performance of the first antenna element 10. In particular, the parasitic coupler 112, through its electromagnetic coupling with the first antenna element 10, provides a further conductor to which current in the first antenna element 10 is effectively transferred, resulting in a more even current distribution in the first antenna element 10. Electromagnetic coupling from both the first antenna element 10 and the parasitic coupler 112 to the second antenna element 50 also disperses current in the first antenna element 10 and the parasitic coupler 112. This provides for an even greater capacity for smoothing current distribution in the first antenna element 10, in that current can effectively be transferred to both the parasitic coupler 112 and the second antenna element 50 when the first antenna element 10 is in operation, when a communication signal is being transmitted or received in an operating frequency band associated with the first antenna element 10.

The length of the parasitic coupler 112, as well as the spacing between the first and second antenna elements 10 and 50 and the parasitic coupler 112, control the electromagnetic coupling between the antenna elements 10 and 50 and the parasitic coupler 112, and thus are adjusted to control the gain and bandwidth of the first antenna element 10 and the second antenna element 50 within their respective first and second operating frequency bands.

Operation of the antenna 111 and the floating conductor pad 30 are otherwise substantially as described above in conjunction with FIG. 9.

Although particular types of antenna elements and parasitic elements are shown in FIG. 12, the present invention is in no way restricted thereto. Alternative embodiments in which other types of elements are implemented are also contemplated, including, for example, antenna elements incorporating features of one or more of the alternative antenna elements in FIGS. 6–8. The relative positions of the various antenna elements and the floating conductor pad may also be different than shown in FIG. 12 for alternative embodiments. Electromagnetic coupling between the first and second antenna elements 10 and 50 is enhanced, for example, by locating the parasitic coupler 112 between the first and second antenna elements 10 and 50. Such an alternative structure provides tighter coupling between the antenna elements. However, an antenna such as the antenna 111, with a weaker coupling between the antenna elements, is useful when some degree of isolation between the first and second antenna elements 10 and 50 is desired. As above, the floating conductor pad 30 need not necessarily be fabricated on the same substrate 113 as the other elements of the antenna 111.

Figure 13:
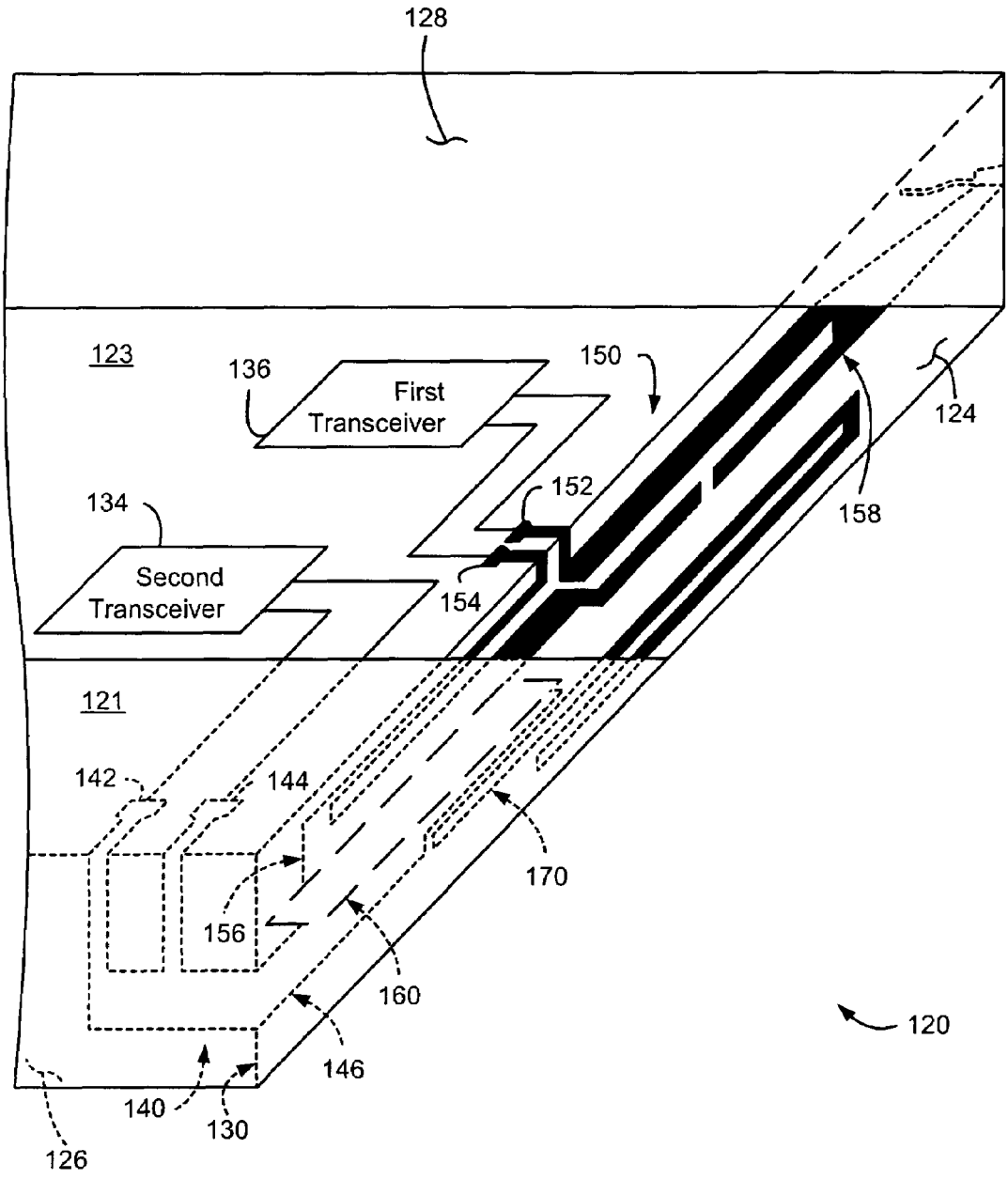
FIG. 13 is an isometric view of another multiple-element antenna mounted in a mobile communication device.

FIG. 13 is an isometric view of another multiple-element antenna mounted in a mobile communication device. As in FIG. 4, the substrate 113, a portion of the front housing wall 121, and a majority of internal components of the mobile device 120 have not been shown in FIG. 13.

The mobile device 120 comprises a case or housing having a front wall 121, a rear wall 123, a top wall 128, a bottom wall 126, and side walls, one of which is shown at 124. In addition, the mobile device 120 includes a first transceiver 136 and a second transceiver 134.

The multiple-element antenna shown in FIG. 13 is similar to the multiple-element antenna 111 in FIG. 12 in that it includes a first antenna element 150, a second antenna element 140, a floating conductor pad 160, and a parasitic coupler 170. The first antenna element 150 is a dipole antenna element, having a port 152 connected to a first conductor section 158 and a second port 154 connected to a second conductor section 156. The ports 152 and 154 are also configured for connection to the first transceiver 136. The second antenna element 140 is similar to the antenna element 50, and comprises ports 142 and 144, configured to be connected to the second transceiver 134, and a top conductor section 146. The antenna elements 140 and 150, the parasitic coupler 170, and possibly the floating conductor pad 160, may be fabricated on a single substrate.

FIG. 13 shows further examples of the possible shapes and types of elements to which the present invention is applicable. The first antenna element 150 is a different dipole antenna element than the antenna element 10. For example, the port 154 is connected to one end of the second conductor section 156 instead of to an intermediate portion thereof, and both conductor sections are shaped differently than those in the antenna element 10. The second antenna element 140 is also different than the second antenna element 50 in the multiple-element antennas of FIGS. 9 and 12, in that the top conductor section 146 has non-uniform width, and includes a notch or cut-away portion in which the parasitic coupler 170 is nested. Further shape, size, and relative position variations will be apparent to those skilled in the art and as such are considered to be within the scope of the present invention.

The multiple-element antenna in FIG. 13 is mounted inside the housing of the mobile device 120, directly on the housing, on a mounting frame attached to the housing or another structural part of the mobile device 120, or on some other part of the mobile device 120. The floating conductor pad 160, as described above in conjunction with FIG. 4, is similarly mounted to or along a section of the mobile device housing, an antenna frame, or another device component, such as a PCB, for example. As described above, the location of the floating conductor pad 160 is preferably selected to optimize its stabilization and possibly noise blocking or canceling effects.

A mobile device in which a multiple-element antenna is implemented may, for example, be a data communication device, a voice communication device, a dual-mode communication device such as a mobile telephone having data communications functionality, a personal digital assistant (PDA) enabled for wireless communications, a wireless email communication device, or a wireless modem operating in conjunction with a laptop or desktop computer or some other electronic device or system.

Figure 14:
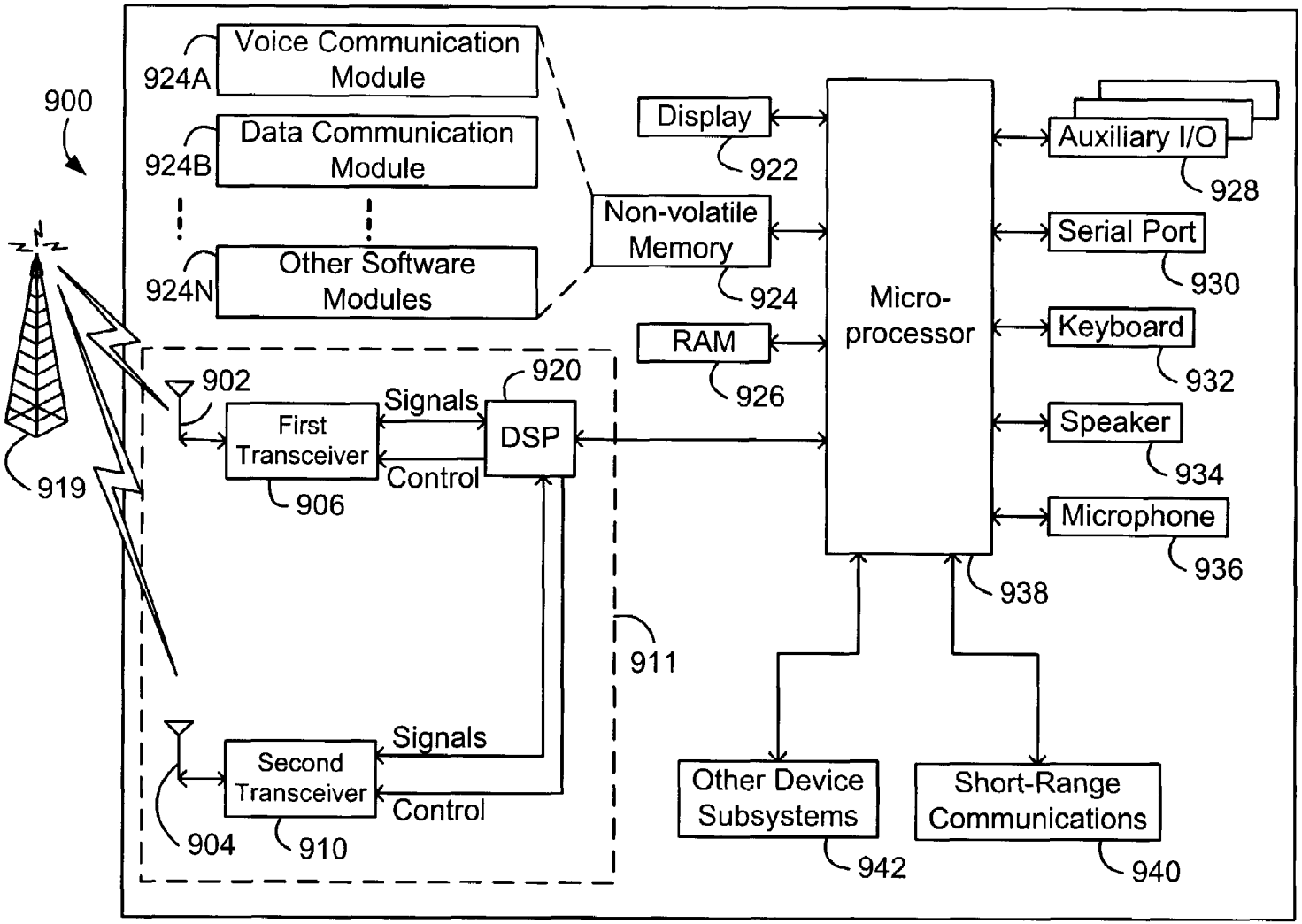
FIG. 14 is a block diagram of a mobile communication device.

FIG. 14 is a block diagram of a mobile communication device. The mobile device 900 is a dual-mode mobile device and includes a transceiver module 911, a microprocessor 938, a display 922, a non-volatile memory 924, random access memory (RAM) 926, one or more auxiliary input/output (I/O) devices 928, a serial port 930, a keyboard 932, a speaker 934, a microphone 936, a short-range wireless communications sub-system 940, and other device sub-systems 942.

The transceiver module 911 includes first and second antennas 902 and 904, a first transceiver 906, a second transceiver 910, and a digital signal processor (DSP) 920. Although not shown separately in FIG. 14, it will be apparent from the foregoing description that in a preferred embodiment, the first and second antennas 902 and 904 are antenna elements in a multiple-element antenna that also incorporates a floating conductor pad.

Within the non-volatile memory 924, the mobile device 900 preferably includes a plurality of software modules 924A–924N that can be executed by the microprocessor 938 (and/or the DSP 920), including a voice communication module 924A, a data communication module 924B, and a plurality of other operational modules 924N for carrying out a plurality of other functions.

The mobile device 900 is preferably a two-way communication device having voice and data communication capabilities. Thus, for example, the mobile device 900 may communicate over a voice network, such as any of the analog or digital cellular networks, and may also communicate over a data network. The voice and data networks are depicted in FIG. 14 by the communication tower 919. These voice and data networks may be separate communication networks using separate infrastructure, such as base stations, network controllers, etc., or they may be integrated into a single wireless network. The transceivers 906 and 910 are normally configured to communicate with different networks 919.

The transceiver module 911 is used to communicate with the networks 919. The DSP 920 is used to send and receive communication signals to and from the transceivers 906 and 910, and provides control information to the transceivers 906 and 910. Information, which includes both voice and data information, is communicated to and from the transceiver module 911 via a link between the DSP 920 and the microprocessor 938.

The detailed design of the transceiver module 911, such as operating frequency bands, component selection, power level, etc., is dependent upon the communication network 919 in which the mobile device 900 is intended to operate. For example, in a mobile device intended to operate in a North American market, the first transceiver 906 may be designed to operate with any of a variety of voice communication networks, such as the Mobitex™ or DataTAC™ mobile data communication networks, AMPS, TDMA, CDMA, PCS, etc., whereas the second transceiver 910 is configured to operate with the GPRS data communication network and the GSM voice communication network in North America and possibly other geographical regions. Other types of data and voice networks, both separate and integrated, may also be utilized with a mobile device 900. The transceivers 906 and 910 may instead be configured for operation in different operating frequency bands of similar networks, such as GSM-900 and GSM-1900, or the CDMA bands of 800 MHz and 1900 MHz, for example.

Depending upon the type of network or networks 919, the access requirements for the mobile device 900 may also vary. For example, in the Mobitex and DataTAC data networks, mobile devices are registered on the network using a unique identification number associated with each mobile device. In GPRS data networks, however, network access is associated with a subscriber or user of a mobile device. A GPRS device typically requires a subscriber identity module ("SIM") in order to operate a mobile device on a GPRS network. Local or non-network communication functions (if any) may be operable, without the SIM device, but a mobile device will be unable to carry out any functions involving communications over the data network 919, other than any legally required operations, such as '911' emergency calling.

After any required network registration or activation procedures have been completed, the mobile device 900 may the send and receive communication signals, including both voice and data signals, over the networks 919. Signals received by the antenna 902 or 904 from the communication network 919 are routed to one of the transceivers 906 and 910, which provide for signal amplification, frequency down conversion, filtering, and channel selection, for example, as well as analog to digital conversion. Analog to digital conversion of a received signal allows more complex communication functions, such as digital demodulation and decoding to be performed using the DSP 920. In a similar manner, signals to be transmitted to the network 919 are processed, including modulation and encoding, for example, by the DSP 920 and are then provided to one of the transceivers 906 and 910 for digital to analog conversion, frequency up conversion, filtering, amplification and transmission to the communication network 919 via the antenna 902 or 904.

In addition to processing the communication signals, the DSP 920 also provides for transceiver control. For example, the gain levels applied to communication signals in the transceivers 906 and 910 may be adaptively controlled through automatic gain control algorithms implemented in the DSP 920. Other transceiver control algorithms could also be implemented in the DSP 920 in order to provide more sophisticated control of the transceiver module 911.

The microprocessor 938 preferably manages and controls the overall operation of the dual-mode mobile device 900. Many types of microprocessors or microcontrollers could be used here, or, alternatively, a single DSP 920 could be used to carry out the functions of the microprocessor 938. Low-level communication functions, including at least data and voice communications, are performed through the DSP 920 in the transceiver module 911. Other, high-level communication applications, such as a voice communication application 924A, and a data communication application 924B may be stored in the non-volatile memory 924 for execution by the microprocessor 938. For example, the voice communication module 924A provides a high-level user interface operable to transmit and receive voice calls between the mobile device 900 and a plurality of other voice or dual-mode devices via the networks 919. Similarly, the data communication module 924B provides a high-level user interface operable for sending and receiving data, such as e-mail messages, files, organizer information, short text messages, etc., between the mobile device 900 and a plurality of other data devices via the networks 919.

The microprocessor 938 also interacts with other device subsystems, such as the display 922, the non-volatile memory 924, the RAM 926, the auxiliary input/output (I/O) subsystems 928, the serial port 930, the keyboard 932, the speaker 934, the microphone 936, the short-range communications subsystem 940 and any other device subsystems generally designated as 942.

Some of the subsystems shown in FIG. 14 perform communication-related functions, whereas other subsystems may provide "resident" or on-device functions. Notably, some subsystems, such as the keyboard 932 and the display 922 are used for both communication-related functions, such as entering a text message for transmission over a data communication network, and device-resident functions such as a calculator, task list, or other PDA type functions.

Operating system software used by the microprocessor 938 is preferably stored in a persistent store such as the non-volatile memory 924. In addition to the operation system, which controls all of the low-level functions of the mobile device 900, the non-volatile memory 924 may include a plurality of high-level software application programs, or modules, such as the voice communication module 924A, the data communication module 924B, an organizer module (not shown), or any other type of software module 924N. These software modules are executed by the microprocessor 938 and provide a high-level interface between a user and the mobile device 900. This interface typically includes a graphical component provided through the display 922, and an input/output component provided through the auxiliary I/O 928, the keyboard 932, the speaker 934, and the microphone 936. The operating system, specific device applications or modules, or parts thereof, may be temporarily loaded into a volatile store such as the RAM 926 for faster operation. Moreover, received communication signals may also be temporarily stored to the RAM 926, before permanently writing them to a file system located in a persistent store such as the non-volatile memory 924. The non-volatile memory 924 may be implemented, for example, as a Flash memory component, or a battery backed-up RAM.

An exemplary application module 924N that may be loaded onto the mobile device 120 is a personal information manager (PIM) application providing PDA functionality, such as calendar events, appointments, and task items. This module 924N may also interact with the voice communication module 924A for managing phone calls, voice mails, etc., and may also interact with the data communication module for managing e-mail communications and other data transmissions. Alternatively, all of the functionality of the voice communication module 924A and the data communication module 924B may be integrated into the PIM module.

The non-volatile memory 924 preferably provides a file system to facilitate storage of PIM data items and other data on the mobile device 900. The PIM application preferably includes the ability to send and receive data items, either by itself, or in conjunction with the voice and data communication modules 924A and 924B, via the wireless networks 919. The PIM data items are preferably seamlessly integrated, synchronized and updated, via the wireless networks 919, with a corresponding set of data items stored or associated with a host computer system, thereby creating a mirrored system for data items associated with a particular user.

The mobile device 900 may also be manually synchronized with a host system by placing the device 900 in an interface cradle, which couples the serial port 930 to the serial port of the host system. The serial port 930 may also be used to enable a user to set preferences through an external device or software application, or to download other application modules 924N for installation. This wired download path may be used to load an encryption key onto the device, which is a more secure method than exchanging encryption information via the wireless network 919. Interfaces for other wired download paths may be provided in the mobile device 900, in addition to or instead of the serial port 930. For example, a Universal Serial Bus (USB) port provides an interface to a similarly equipped personal computer.

Additional application modules 924N may be loaded onto the mobile device 900 through the networks 919, through an auxiliary I/O subsystem 928, through the serial port 930, through the short-range communications subsystem 940, or through any other suitable subsystem 942, and installed by a user in the non-volatile memory 924 or the RAM 926. Such flexibility in application installation increases the functionality of the mobile device 120 and may provide enhanced on-device functions, communication-related functions, or both. For example, secure communication applications enable electronic commerce functions and other such financial transactions to be performed using the mobile device 900.

When the mobile device 900 is operating in a data communication mode, a received signal, such as a text message or a web page download, is processed by the transceiver module 911 and provided to the microprocessor 938, which preferably further processes the received signal for output to the display 922, or, alternatively, to an auxiliary I/O device 928. A user of mobile device 900 may also compose data items, such as email messages, using the keyboard 932, which is preferably a complete alphanumeric keyboard laid out in the QWERTY style, although other styles of complete alphanumeric keyboards such as the known DVORAK style may also be used. User input to the mobile device 900 is further enhanced with a plurality of auxiliary I/O devices 928, which may include a thumbwheel input device, a touchpad, a variety of switches, a rocker input switch, etc. The composed data items input by the user may then be transmitted over the communication networks 919 via the transceiver module 911.

When the mobile device 900 is operating in a voice communication mode, the overall operation of the mobile device is substantially similar to the data mode, except that received signals are preferably be output to the speaker 934 and voice signals for transmission are generated by the microphone 936. Alternative voice or audio I/O subsystems, such as a voice message recording subsystem, may also be implemented on the mobile device 900. Although voice or audio signal output is preferably accomplished primarily through the speaker 934, the display 922 may also be used to provide an indication of the identity of a calling party, the duration of a voice call, or other voice call related information. For example, the microprocessor 938, in conjunction with the voice communication module and the operating system software, may detect the caller identification information of an incoming voice call and display it on the display 922.

A short-range communications subsystem 940 is also included in the mobile device 900. For example, the subsystem 940 may include an infrared device and associated circuits and components, or a short-range RF communication module such as a Bluetooth™ module or an 802.11 module to provide for communication with similarly-enabled systems and devices. Those skilled in the art will appreciate that "Bluetooth" and "802.11" refer to sets of specifications, available from the Institute of Electrical and Electronics Engineers, relating to wireless personal area networks and wireless local area networks, respectively.

This written description uses examples to disclose the invention, including the best mode, and also to enable any person skilled in the art to make and use the invention. The invention may include other examples that occur to those skilled in the art.

We claim:

1. A floating conductor pad for a wireless communication device, the wireless communication device having an antenna element and a plurality of device components, the antenna element fabricated from a conductive material using etching, the antenna element fabricated on a substrate, the floating conductor pad comprising a patch of conductive material fabricated on a flat substrate, the floating conductor pad positioned in the wireless communication device such that at least a portion of the floating conductor pad is adjacent to at least a portion of the antenna element and positioned such that the proximity of the antenna element and the floating conductor pad results in electromagnetic coupling between the antenna element and the floating conductor pad, the floating conductor positioned to reduce the level of noise that could couple to the antenna element from at least one of the device components in the wireless communication device.

2. The floating conductor pad of claim 1, wherein the patch of conductive material has a rectangular shape.

3. The floating conductor pad of claim 1, wherein the conductive material is selected from the group consisting of: copper and silver.

4. The floating conductor pad of claim 1, wherein the floating conductor pad is fabricated on a single dielectric substrate with the antenna element.

5. The floating conductor pad of claim 1, wherein the device components include a printed circuit board, and wherein the floating conductor pad is mounted on the printed circuit board.

6. The floating conductor pad of claim 1, wherein the device components include a plurality of printed circuit boards, and wherein the floating conductor pad is configured to be mounted on one of the plurality of printed circuit boards.

7. The floating conductor pad of claim 6, wherein the one of the plurality of printed circuit boards supports components of a keyboard of the wireless communication device.

8. The floating conductor pad of claim 7, wherein dimensions and orientation of the floating conductor pad are selected so as to reduce noise generated by operation of the keyboard.

9. The floating conductor pad of claim 1, wherein the floating conductor pad masks the antenna from effects of variations in the device components.

10. An antenna for a wireless communication device, the wireless communication device having a plurality of device components, the antenna comprising:

a first antenna element fabricated from a conductive material using etching, the first antenna element fabricated on a substrate; and a floating conductor pad fabricated from a conductive material, the floating conductor pad fabricated on a substrate, the floating conductor pad positioned in the wireless communication device such that at least a portion of the floating conductor pad is adjacent to at least a portion of the first antenna element and positioned such that the proximity of the first antenna element and the floating conductor pad results in electromagnetic coupling between the first antenna element and the floating conductor pad, the floating conductor positioned to reduce the level of noise that could couple to the first antenna element from at least one of the device components in the wireless communication device.

11. The antenna of claim 10, wherein the first antenna element comprises a first conductor section and a second conductor section, and wherein the floating conductor pad comprises a conductive patch adjacent one but not the other of the first conductor section and the second conductor section.

12. The antenna of claim 10, further comprising:

a second antenna element fabricated on a substrate and positioned adjacent to the first antenna element and the floating conductor pad, the second antenna element having an operating frequency band that is different from the operating frequency band of the first antenna element.

13. The antenna of claim 12, wherein the first antenna element and the second antenna element are located on the same substrate.

14. The antenna of claim 10, wherein the substrate on which the first antenna element is fabricated is a flexible dielectric substrate.

15. The antenna of claim 14, wherein the substrate on which the first antenna element is fabricated and the first antenna element are folded from an original substantially flat configuration so as to orient the first antenna element in multiple planes.

16. The antenna of claim 10, wherein the conductive material from which the floating conductor pad is fabricated is selected from the group consisting of copper and silver.

17. The antenna of claim 10, wherein the first antenna element and the floating conductor pad are fabricated on the same substrate.

18. The antenna of claim 12, wherein the operating frequency band of the first antenna element includes both an 1800 MHz communication frequency band and a 1900 MHz communication frequency band, and wherein the operating frequency band of the second antenna element comprises a 900 MHz communication frequency band.

19. A wireless mobile communication device comprising:

a transceiver incorporating transceiver components;

a first antenna element fabricated from a conductive material using etching, the first antenna element fabricated on a substrate, the first antenna element connected to the transceiver; and a floating conductor pad fabricated from a conductive material, the floating conductor pad fabricated on a substrate, the floating conductor pad positioned in the wireless communication device such that at least a portion of the floating conductor pad is adjacent to at least a portion of the first antenna element and positioned such that the proximity of the first antenna element and the floating conductor pad results in electromagnetic coupling between the first antenna element and the floating conductor pad, the floating conductor pad positioned to reduce the level of noise that could couple to the first antenna element from the transceiver components in the mobile communication device.

20. The wireless mobile communication device of claim 19, wherein the substrate on which the floating conductor pad is fabricated is a printed circuit board.

21. The wireless mobile communication device of claim 19, wherein the wireless mobile communication device is selected from the group consisting of: a data communication device, a voice communication device, a dual-mode communication device, a mobile telephone having data communications functionality, a personal digital assistant (PDA) enabled for wireless communications, a wireless email communication device, and a wireless modem.

22. The wireless mobile communication device of claim 19, further comprising:

a first printed circuit board; and a second printed circuit board, wherein the floating conductor pad is positioned between the first printed circuit board and the second printed circuit board.

23. The wireless mobile communication device of claim 22, wherein the first printed circuit board carries the transceiver components, and wherein the second printed circuit board carries components of a keyboard of the wireless mobile communication device.

* * * * *